United States Patent [19]

Alexander

[11] 4,456,947

[45] Jun. 26, 1984

[54] MOTOR VEHICLE HEADLIGHT WITH CONTACT LUG DEFINING ADHESIVE RESERVOIR

[75] Inventor: Kenneth E. Alexander, Seymour, Ind.

[73] Assignee: GTE Products Corporation, Stamford, Conn.

[21] Appl. No.: 385,998

[22] Filed: Jun. 7, 1982

[51] Int. Cl.[3] ..... F21V 31/02

[52] U.S. Cl. ..... 362/267; 362/306; 362/308; 362/310; 362/83; 313/113; 313/331

[58] Field of Search ..... 362/267, 306, 308, 310, 362/83; 313/113, 315, 331, 332

[56] References Cited

U.S. PATENT DOCUMENTS

| | | | |
|---|---|---|---|
| 2,414,604 | 1/1947 | Newcombe . | |
| 2,644,100 | 6/1953 | Braunsdorff . | |
| 2,870,362 | 1/1959 | Arnold et al. | 313/113 |
| 2,890,920 | 6/1959 | Falge . | |
| 3,010,045 | 11/1961 | Plagge et al. . | |
| 3,441,771 | 4/1969 | Honeycutt . | |
| 3,917,939 | 11/1975 | Schmidt et al. . | |
| 4,039,878 | 8/1977 | Erjkelenboom et al. | 313/113 |
| 4,146,812 | 3/1979 | Gagnon . | |
| 4,181,869 | 1/1980 | Warren et al. . | |
| 4,262,228 | 4/1981 | Cruse . | |
| 4,300,189 | 11/1981 | Shanks . | |
| 4,302,697 | 11/1981 | Demas et al. | 313/113 |
| 4,403,276 | 9/1983 | Blaisdell | 362/306 X |

*Primary Examiner*—Peter A. Nelson

*Attorney, Agent, or Firm*—Lawrence R. Fraley

[57] ABSTRACT

A motor vehicle headlight having an improved lug and eyelet construction in which there is a reservoir formed between the lug and a boss formed on the reflector. This reservoir is for trapping and containing excess adhesive which is present during the assembly of such headlights.

10 Claims, 2 Drawing Figures

MOTOR VEHICLE HEADLIGHT WITH CONTACT LUG DEFINING ADHESIVE RESERVOIR

DESCRIPTION

TECHNICAL FIELD

The present invention relates in general to headlights such as those manufactured for automotive (motor vehicle) applications. More particularly, the present invention relates to an improved external contact lug and eyelet construction having reservoir means to trap and contain excess adhesive which may occur during the assembly of such headlights.

BACKGROUND

Representative prior art illustrative of motor vehicle headlights includes U.S. Pat. Nos. 4,146,812 (Gagnon) and 4,181,869 (B. Warren et al), both of which are assigned to the same assignee as the instant invention. In particular, in U.S. Pat. No. 4,181,869, there is disclosed a tungsten-halogen lamp sealed in a reflector envelope employing lead-in conductors (wires) which pass through the reflector and are adapted for being supported by an eyelet and associated lug member. The eyelet extends through an aperture in the glass reflector while the lug interconnects with the eyelet and is adapted to receive an electrical connector external of the reflector envelope.

During the assembly and manufacture of headlights of the above variety, an adhesive such as an epoxy resin in a paste or semi-liquid form is dispensed into cavities or apertures in the glass reflector in order to provide improved sealing of the glass reflector to the aforementioned metallic lug and eyelet. Because of manufacturing variations in the size of the reflector's openings which are to be filled, as well as manufacturing variations in the assembly process, the proper amount of epoxy adhesive necessary to fill the orifice or orifices varies from lamp to lamp. During the manufacturing process, to be on the safe side, it is thus preferred to dispense more (an excess) adhesive than might be needed. Therefore, in prior at headlights when the lug was fastened to the eyelet and glass, the excess epoxy was often squeezed out to the outside edges of the lug and occasionally onto the glass reflector. This in turn caused problems both in the handling and additional processing of the headlight through the remainder of the assembly procedure. For example, there was often a charring of the exces epoxy which occurred during a subsequent soldering step, resulting in an unsightly appearance of the finished product. In addition, excess adhesive often caused "bad solder" defects as a result of its being present on surfaces of the lug and/or eyelet which eventually receive the solder typically employed on headlights to secure the headlight's lead-in support wire relative to the eyelet and contact lug members.

DISCLOSURE OF THE INVENTION

Accordingly, it is an object of the present invention to provide an improvement in the manufacture of motor vehicle headlights by providing an improved lug construction formed to provide a self-contained reservoir to trap and contain excess adhesive during the assembly of the headlight.

Another object of the present invention is to provide an improved motor vehicle headlight which is manufactured to be cleaner by eliminating unsightly black marks caused by charring of excess adhesive thereon during soldering, which is easier to handle during the manufacturing process, and which substantially eliminates the possibility of "bad solder" defects found in prior art headlights.

To accomplish the foregoing and other objects of this invention, there is provided a motor vehicle headlight which comprises an electric lamp, a glass reflector defining at least one opening therein for receiving a lead-in support wire adapted to connect to the electric lamp, and an external boss portion disposed about the opening. A metal eyelet extends through the reflector's opening and has an outer end portion extending above the boss portion. The lead-in support wire actually extends directly through the hollow metal eyelet. An external contact lug also has a hole (aperture) therethrough for receiving the outer end portion of the metal eyelet. The eyelet is secured to the contact lug at its base portion. In accordance with the invention, the base portion of the contact lug defines a reservoir disposed over the reflector opening for accommodating excess adhesive therein, which adhesive may be present during the assembly of the lamp. The eyelet preferably has an inner end portion in the form of an angled head shaped to approximately conform to the reflector's internal curvature. The lug also preferably comprises a connector engaging arm portion extending from the base portion. There are essentially two versions of the invention described herein, one in which the base portion of the lug has an elevated section which is tapered (or cupped), and the other in which the elevated section is stepped. In manufacturing the lamp of this invention, the solder means is provided preferably in the form of a solder ring that is melted to effect solder flow and contact with the eyelet outer end portion, lug base portion, and lead-in support wire.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
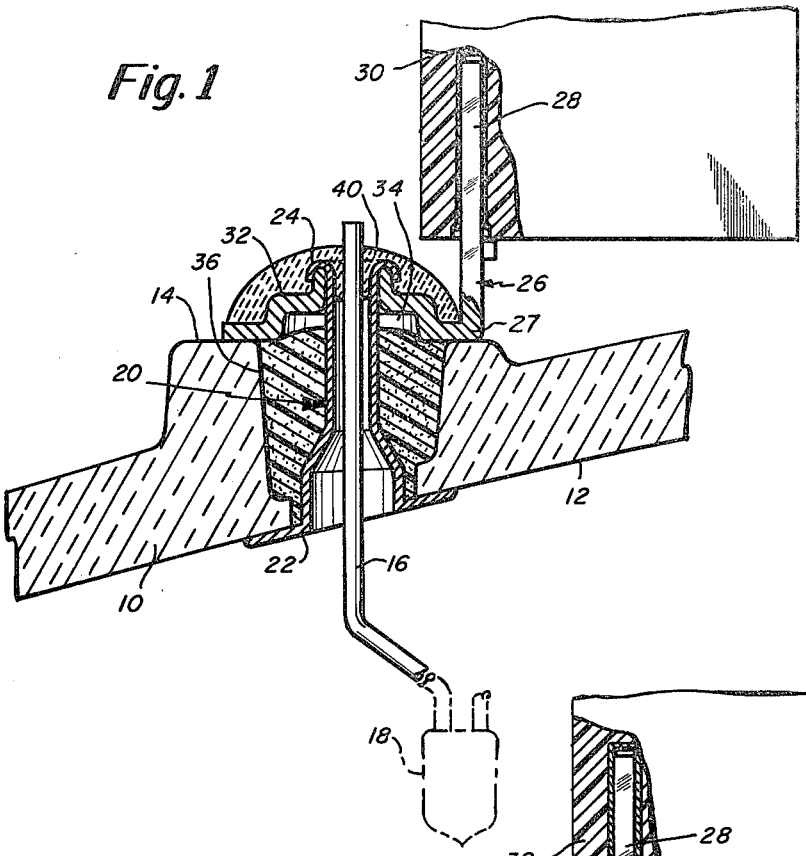
FIG. 1 is a fragmentary sectional view of an improved lug construction in accordance with one embodiment of this invention.
Figure 2:
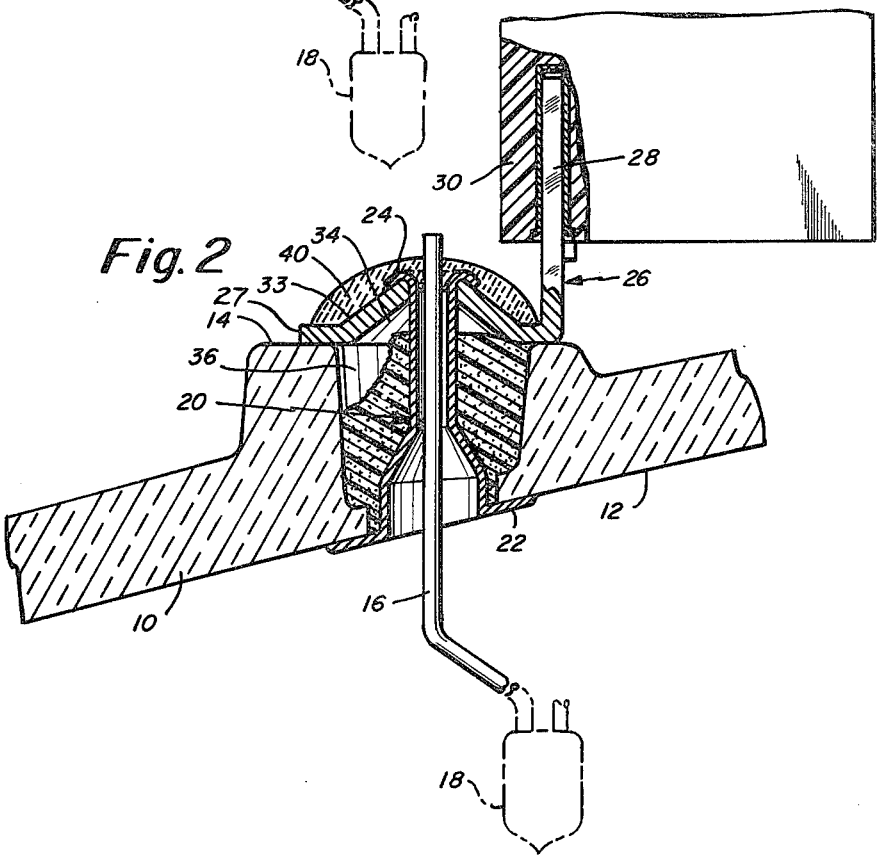
FIG. 2 is a fragmentary sectional view of an improved lug construction in accordance with a second embodiment of this invention.

A motor vehicle headlight in accordance with the present invention is shown in two different embodiments in FIGS. 1 and 2. Because these embodiments are quite similar, like reference characters are used to identify like parts in the two embodiments. The headlight, which is not shown in its entirety in FIGS. 1 and 2, may also comprise a glass or plastic lens bonded to the front of the headlight's curved (usually parabolic) glass or plastic reflector (10). The drawing illustrates only a fragment of glass reflector 10, which includes an inner curved reflective surface 12 and an external boss portion 14 which extends above the reflector's external surface. Boss 14 may be of circular shape in a plan view of FIGS. 1 and 2. In addition to the fragment of the glass reflector 10, FIGS. 1 and 2 also show the headlight's lead-in support wire 16 which extends through an opening in the glass reflector, and, in phantom, the electric lamp 18 which also forms part of the headlight. A preferred electric lamp is a tungsten-halogen capsule such as illustrated in U.S. Pat. No. 4,146,812. Lamps of this type are well known in the art and further definition is thus not provided. Lamp 18, is one version of the invention, was rated at thirty-six watts, twelve volts.

The support wire 16 illustrated in FIGS. 1 and 2 is for supporting the lamp 18. Although not illustrated in the drawing, it is understood that the reflector 10 in a typical application also includes additional lead-in support wires and associated contact lugs. For example, see U.S. Pat. No. 4,181,869.

As illustrated in FIGS. 1 and 2, the opening in the glass reflector extends from boss portion 14 through the reflector surface 12. This opening receives a metal eyelet 20 having at its inner end an angled head section 22 which is angled and shaped to approximately the same contour as the curvature of surface 12 so as to lie flush thereagainst. The outer end portion 24 of metal eyelet 20 is illustrated in FIGS. 1 and 2 as being flattened or peened over so as to secure both the external contact lug 26 and the eyelet to the glass reflector. The eyelet is thus essentially riveted to lug 26, but only as one of the final steps of assembly.

The external contact lug 26 includes an upstanding arm 28 which extends normal from the flat surface of boss 14. Arm 28 provides for connection to an electrical connector 30. With particular reference to the embodiment of FIG. 1, the external contact lug 26, in addition to including the arm 28, also comprises a stepped base portion 32 having a centrally disposed aperture for receiving the outer end portion 24 of the eyelet 20. As shown in both FIGS. 1 and 2, the base portion of lug 26 includes a peripheral edge portion 27 which is designed for resting snugly atop the upper surface of boss 14 and the defined, elevated portion either in the form of a stepped shape (FIG. 1) or a tapered shape (below), said elevated portion extending upwardly from edge 27. It can be seen in the drawing that the lug's aperture is centrally disposed within the base's elevated portion. Initially, the outer end of the eyelet is not flattened, said end instead originally being of continuous tubular shape so that it readily passes through the centrally disposed aperture in the lug base 32. The stepped base 32, in combination with the eyelet and the upper surface of boss 14, provides a reservoir 34 for excess adhesive (shown in the reflector's opening about eyelet 20) which, as stated, is applied during manufacture of the invention. The reservoir 34 overlies and is contiguous with the adhesive space (reflector opening) 36. The space 36, as clearly depicted in FIG. 1, surrounds the eyelet 20 and narrows toward the angled head of the eyelet. The drawing also shows the melted solder cap 40 which is formed from a solder ring disposed at the top of the support wire 16 and then melted to thereby join the eyelet, lug, and support wire. A small amount of excess adhesive is shown extending upwardly within the stepped, elevated portion of lug 26.

The embodiment of FIG. 2 differs from that shown in FIG. 1 primarily by the construction of the base portion of the external contact lug 26. In the embodiment of FIG. 2, the lug 26 also includes the arm 28 but has a differently shaped base portion 33, said portion also containing a centrally disposed aperture therein, however. Base 33 is tapered, and, as also shown in FIG. 2, partially cupped. Like the base in FIG. 1, however, the base is formed so as to define a reservoir immediately adjacent the opening in the reflector and above the surface of boss 14 to accommodate for excess epoxy or the like adhesive.

In the assembly of the lug and eyelet, the eyelet is first introduced through the hole in the reflector 10 with its outer end portion not yet riveted (set) to lug 26. The shown adhesive is then applied to substantially fill the reflector's opening, thereby surrounding eyelet 20 and providing more rigidity as well as assuring an effective seal. The lug is then placed over the upstanding end of the eyelet and the lead-in support wire 16 is also held in place in the position illustrated in the drawing. In accordance with the invention as described, the lug is constructed with the defined excess adhesive area over the top surface of boss 14 and over the normal space (opening) 36 for the adhesive so that excess adhesive introduced into the space has some place to go when the lug is placed on top of the eyelet and the eyelet is riveted (e.g., by flattening or peening) at its end 24 to the lug's base. In the drawing, the reservoir is shown as being only partially filled but it should be understood that the reservoir is sufficiently large so as to accommodate even more of this material (even to the point of completely filling the reservoir).

Several advantages are realized with the construction of the present invention. Because of the excess epoxy reservoir there is provided a cleaner lamp construction due to the lack of exposed epoxy. As stated, excess epoxy previously tended to interfere with the handling of the lamp during assembly. Also, the black marks typically caused by charring of the epoxy during soldering have also been eliminated. In addition, exposed metal parts are not contaminated by epoxy and/or fumes from the epoxy. Another advantage is that, with the elevated base construction on the external contact lug, there is improved solder flow down the tapered or stepped portion of the base. Furthermore, and perhaps more importantly, with either the tapered or stepped base configurations shown, there is surprisingly provided a flexing action by the base that occurs during the riveting of the eyelet to the base, thereby facilitating headlight assembly and furthermore decreasing the possibility of glass breakage (of the reflector) due to excess pressure applied during said riveting.

A preferred adhesive for use herein is an epoxy resin, several of which are known in the art. A suitable solder is a 60/40 tin-lead composition, although a 20/80 tin-lead composition will suffice. Lug 26 is 30 mil thickness brass, and eyelet 20 can be produced from brass (e.g., 10 mil thickness), aluminum, copper, steel (e.g., mild or stainless), or a nickel-iron alloy known in the art. Reflector 10 may be of any suitable glass presently used in the art.

While there have been shown and described what are at present considered the preferred embodiments of the invention, it will be obvious to those skilled in the art that various changes and modifications may be made therein without departing from the scope of the invention as defined by the appended claims.

I claim:

1. In a motor vehicle headlight including an electric lamp, a glass reflector defining at least one opening therein and having a first reflective surface for reflecting light from said electric lamp and a second external surface including a boss portion extending above said second surface and surrounding said opening, a metal eyelet positioned substantially within said opening and including an outer end portion projecting above said boss portion, a quantity of adhesive located within said opening and surrounding said eyelet, an external contact lug having a base portion positioned on said boss portion and including an aperture therein, said outer end portion of said eyelet secured to said base portion of said contact lug, and a lead-in support wire extending through said metal eyelet and said aperture within said base portion of said contact lug for being electrically connected to said electric lamp, the improvement wherein said base portion of said external contact lug includes a peripheral edge portion for resting on said boss portion of said reflector and an elevated portion extending upwardly from said edge portion and having said aperture therein, said base portion defining a reservoir immediately adjacent said opening within sad glass reflector and extending above said boss portion for accommodating excessive amounts of said adhesive which may occur during assembly of said headlight.

2. The improvement according to claim 1 wherein said base portion of said external contact lug is capable of being flexed during securement of said outer end portion of said eyelet thereto.

3. The improvement according to claim 1 wherein the securement of said outer end portion of said eyelet to said base portion of said contact lug provides securement for both said eyelet and said contact lug to said glass reflector.

4. The improvement according to claim 1 wherein said elevated portion of said lug is of stepped configuration.

5. The improvement according to claim 1 wherein said elevated portion of said lug is of tapered configuration.

6. The improvement according to claim 1 further including solder means located substantially on said base portion of said contact lug and joining said base portion, said outer end portion of said metal eyelet, and said lead-in support wire.

7. The improvement according to claim 1 wherein said external contact lug further includes an upstanding connector engaging arm portion extending from said base portion.

8. The improvement according to claim 1 wherein said external contact lug is comprised of brass.

9. The improvement according to claim 1 wherein the material for said metal eyelet is selected from the group consisting of aluminum, brass, copper, steel, and a nickel-iron alloy.

10. The improvement according to claim 1 wherein said adhesive is an epoxy resin.

* * * * *